US007077571B1

(12) United States Patent
Wilson

(10) Patent No.: US 7,077,571 B1
(45) Date of Patent: Jul. 18, 2006

(54) COLLAPSIBLE AND DISPOSABLE TRASH RECEPTACLE

(76) Inventor: Patricia B. Wilson, 3671 Tioga Way, Las Vegas, NV (US) 89109

( * ) Notice: Subject to any disclaimer, the term of this patent is extended or adjusted under 35 U.S.C. 154(b) by 0 days.

(21) Appl. No.: 11/158,631

(22) Filed: Jun. 23, 2005

(51) Int. Cl.
*B65D 30/20* (2006.01)

(52) U.S. Cl. ..... 383/120; 383/907; 220/908

(58) Field of Classification Search ..... 383/120, 383/109, 121, 902, 907; 220/495.06, 62.14, 220/908, 62.21; 362/352, 347
See application file for complete search history.

(56) References Cited

U.S. PATENT DOCUMENTS 2,796,517 A * 6/1957 Herzfelder ..... 362/352
2,833,460 A * 5/1958 Votolato ..... 383/36
4,166,572 A 9/1979 Leeds
4,628,007 A 12/1986 Ledsham
4,660,758 A 4/1987 Tavel et al.
4,747,352 A 5/1988 Guidry et al.
4,764,029 A 8/1988 Abblett
4,941,754 A * 7/1990 Murdock ..... 383/3
2004/0066987 A1 4/2004 O'Neill

* cited by examiner

*Primary Examiner*—Robin A. Hylton

(57) ABSTRACT

A device includes a base member that has inner and outer layers abutted thereagainst. An upper body extends upwardly from the base member and has a top end portion aligned about a longitudinal axis of the receptacle. The upper body has a deformably resilient outer surface including a plurality of coextensive pleats equidistantly spaced about a circumference of the upper body wherein longitudinal length of the pleats is greater than width of the pleats. Such pleats extend along a longitudinal length of the upper body and are simultaneously adaptable during operating conditions. The base member and the upper body are adaptable between compressed and expanded positions. The base member has a substantially cylindrical shape when adapted to an expanded position and the upper body has a spherical shape when adapted to an expanded position. Such an upper body has a circumference greater than the circumference of the base member.

15 Claims, 4 Drawing Sheets

COLLAPSIBLE AND DISPOSABLE TRASH RECEPTACLE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to trash receptacles and, more particularly, to a collapsible and disposable trash receptacle sized and shaped to be seated on a dining table.

2. Prior Art

An attractive public restaurant is characterized by an appearance of neatness and cleanliness. This is difficult to maintain when dining tables quickly become cluttered with various paper and plastic items provided largely in conformance with sanitary regulations. Such items consist of paper envelopes for sugar, waxed paper covers for wafers, paper covers for drinking straws, waxed paper covers for butter pats, plastic jelly containers, tooth picks used with hors d'oeuvres, notwithstanding trash associated with smoking, such as plastic cigar covers and paper cigar bands, empty match covers and tops of cigarette packages.

One example to this approach provides a convenient trash receptacle in which diners can dispose of these pieces of paper and plastic as they appear so as to keep them out of sight, at the same time avoiding the possibility of creating a small blaze resulting from trash being carelessly dropped in an ashtray containing a lit cigarette. Another prior means of performing table trash disposal has been used in a self-service "fast food" restaurant by providing a large slot in the top of the table, giving access to a container beneath the table. It is obvious that this solution is hardly suitable for an attractive restaurant with cloth-covered tables.

Accordingly, a need remains for a collapsible and disposable trash receptacle in order to overcome the above-noted shortcomings. The present invention satisfies such a need by providing a collapsible and disposable trash receptacle that is convenient, sanitary, disposable, lightweight, compact, durable, practical, inexpensive, and easy to use. The collapsible and disposable trash receptacle appeals to the food service industry, homeowners, and the like, or those concerned with overall cleanliness and sanitation.

BRIEF SUMMARY OF THE INVENTION

In view of the foregoing background, it is therefore an object of the present invention to provide a device for a collapsible and disposable trash receptacle. These and other objects, features, and advantages of the invention are provided by a trash receptacle sized and shaped to be seated on a dining table.

The device includes a base member formed from flexible material including an inner layer and an outer layer abutted thereagainst and an upper body monolithically formed with the base member and extending upwardly therefrom. The upper body has an open top end portion centrally aligned about a longitudinal axis of the receptacle and further has a deformably resilient outer surface including a plurality of coextensive pleats equidistantly spaced about a circumference of the upper body wherein the longitudinal length of the pleats is greater than the width of the pleats. The pleats extend along a longitudinal length of the upper body and is simultaneously adaptable during operating conditions.

The base member and the upper body are adaptable between compressed and expanded positions. The base member has a substantially cylindrical shape when adapted to an expanded position. The upper body has a spherical shape when adapted to an expanded position such that the upper body has a circumference greater than the circumference of the base member.

The pleats preferably include a plurality of monolithically formed coextensive side portions radially extending away from the longitudinal axis and conveniently adjustable between expanded and compressed positions such that a volume of the upper body can be selectively expanded when the side portions are adapted to a position tangential to the circumference of the upper body. Such a bottom surface of the base member may have a plurality of coextensive lines of weakness so that the base member can be effectively compressed to a planar position.

The upper body defines a width equal to a width of the base member when at a compressed position such that the receptacle can be readily stored, and defines a spherical cavity therein when adapted to the expanded position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
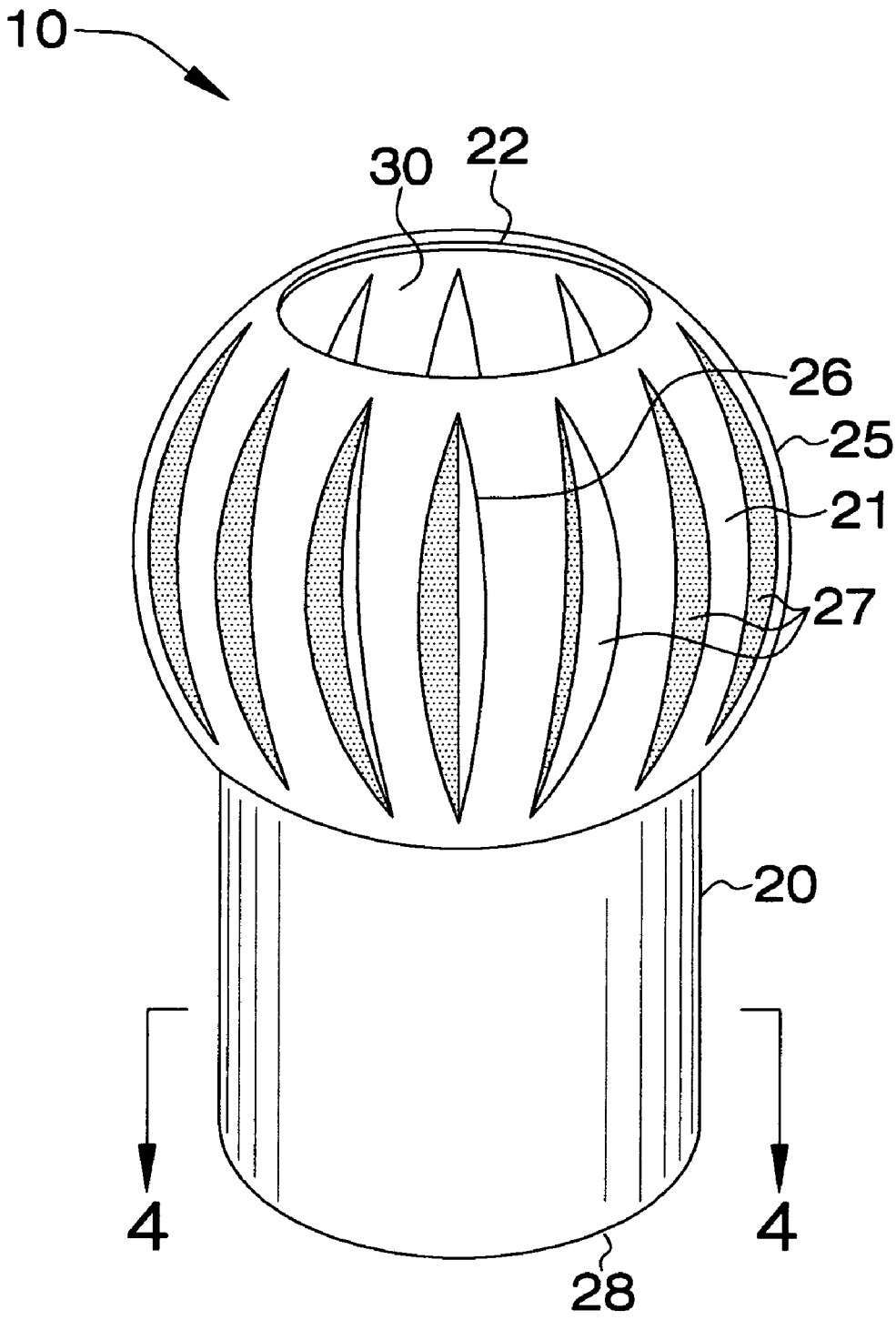
FIG. 1 is a perspective view of the device showing a collapsible and disposable trash receptacle, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1–5 by the reference numeral 10 and is intended to provide a collapsible and disposable trash receptacle. It should be understood that the device 10 may be used as a receptacle in many different types of environments and should not be limited in use only for refuse.

Referring initially to FIGS. 1, 2, 3, and 5, the device 10 includes a base member 20 formed from flexible material including an inner layer 23 and an outer layer 24 abutted thereagainst. The device 10 further includes an upper body 21 monolithically formed with the base member 20 and extending upwardly therefrom. Such an upper body 21 has an open top end portion 22 centrally aligned about a longitudinal axis of the receptacle 10 and further has a deformably resilient outer surface 25 including a plurality of critical and coextensive pleats 26 equidistantly spaced about a circumference of the upper body 21 wherein the longitudinal length of the pleats 26 is greater than the width of the pleats 26. Such pleats 26 extend along a longitudinal length of the upper body 21 and are simultaneously adaptable during operating conditions. The device 10 provides a receptacle for empty cellophane wrappers, gum, condiment packets, stir sticks, sugar packets, creamer containers, etc, as is obvious to one having ordinary skill in the art.

Figure 2:
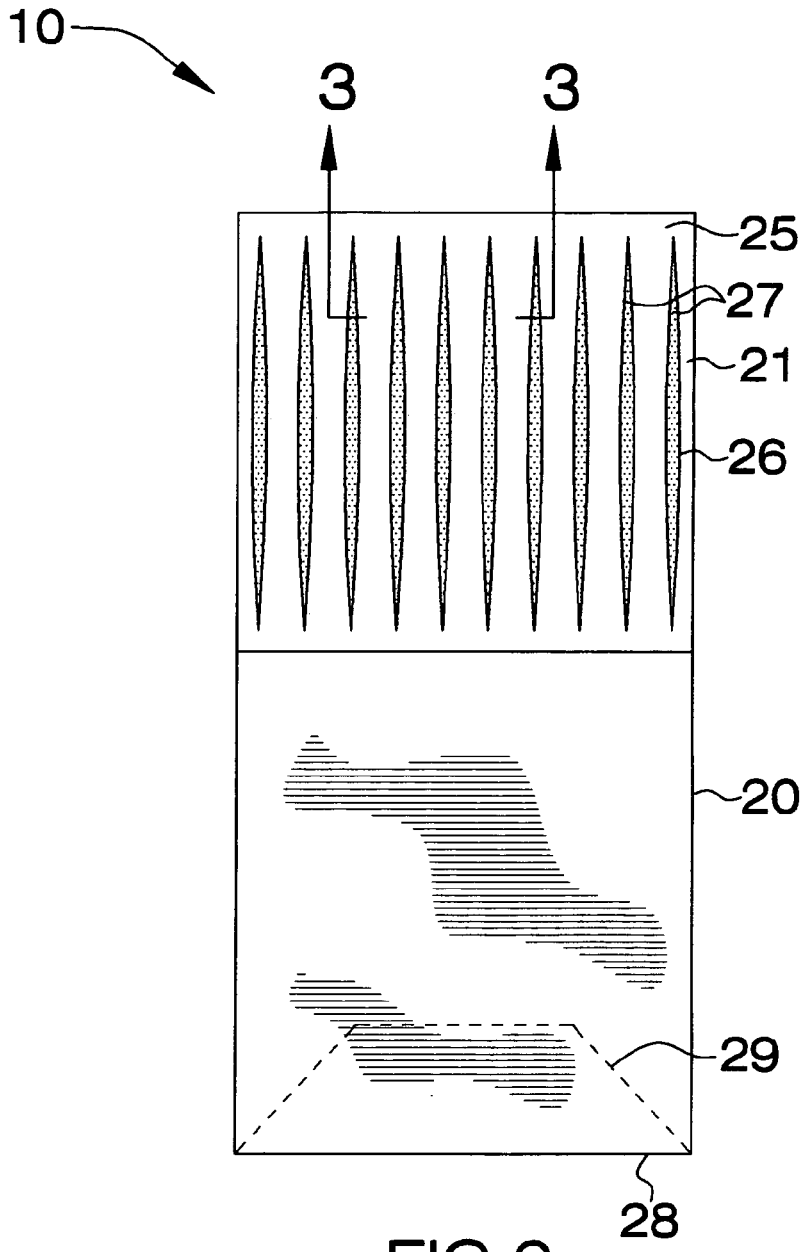
FIG. 2 is a top plan view of the device shown in FIG. 1, at a compressed position.
Figure 3:
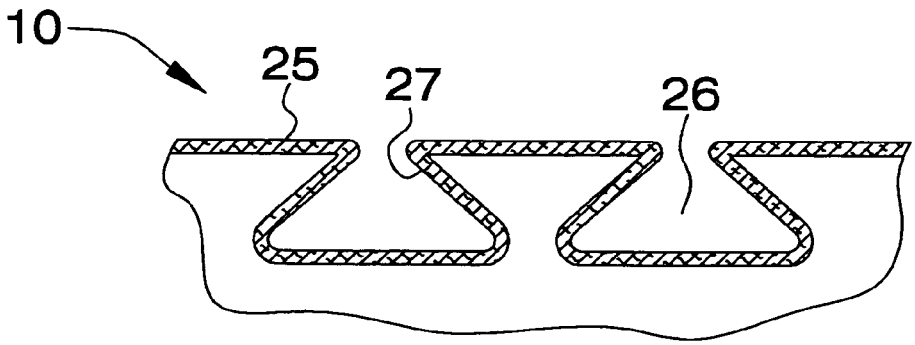
FIG. 3 is a cross-sectional view of the pleats shown in FIG. 2, taken along lines 3—3.
Figure 4:
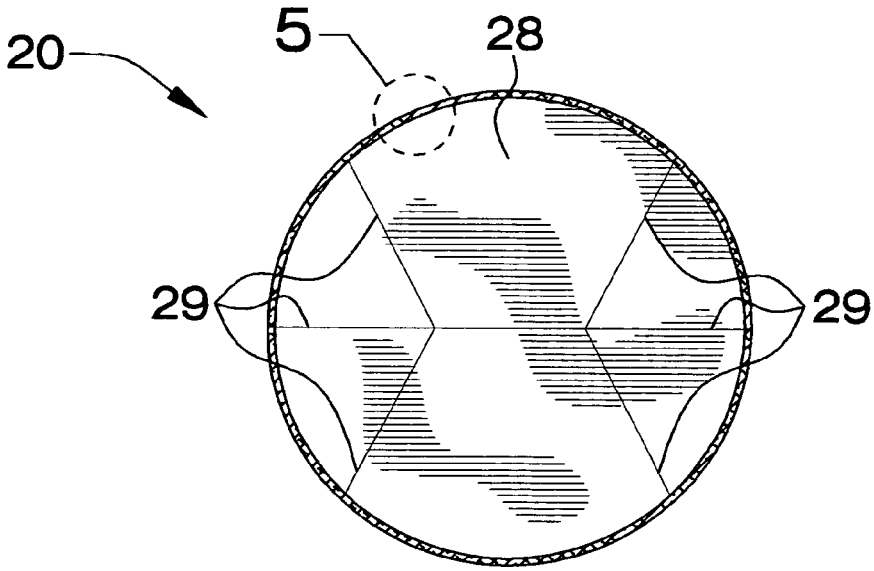
FIG. 4 is a cross-sectional view of the device shown in FIG. 1 taken along lines 4—4.
Figure 5:
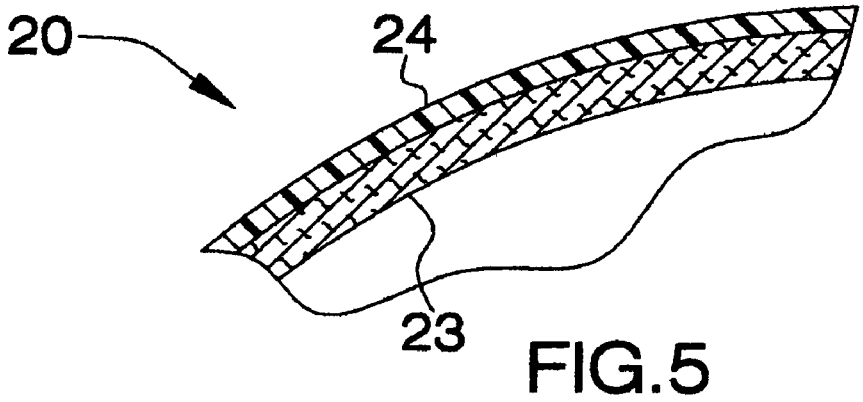
FIG. 5 is an enlarged cross-sectional view of the wall in FIG. 4 shown in section 5.

Now referring to FIGS. 1, 2 and 3, a base member 20 and the upper body 21 are adaptable between compressed and expanded positions. The base member 20 has a substantially cylindrical shape when adapted to an expanded position. The upper body 21 has a spherical shape when adapted to an expanded position such that the upper body 21 has a circumference greater than the circumference of the base member. When full, the device 10 could be easily removed and simply thrown away. Of course, the device 10 could be produced in a wide range of colors, shapes, designs, styles, and sizes, as is obvious to one having ordinary skill in the art. In addition, the outer layer 24 could be imprinted with various logos, names, trivia, fun facts, etc.

Referring to FIGS. 1, 2, 3, and 4, the pleats 26 include a plurality of monolithically formed coextensive side portions 27 radially extending away from the longitudinal axis and adjustable between expanded and compressed positions such that a volume of the upper body 21 can be selectively expanded when the side portions 27 are adapted to a position tangential to the circumference of the upper body 21. Such side portions 27 are essential to the operation of the device 10 so that the pleats 26 can be easily expanded and compressed. The bottom surface 28 of the base member 20 has a plurality of essential coextensive lines of weakness 29 so that the base member 20 can be effectively compressed to a planar position for easy storage. In operation, a user could simply open the base member 20 to expand upper body 21. Trash, such as lettuce, tomato, shrimp tails, salt and pepper packets, chicken wings, tea bags, and the like could be deposited into the device 10.

Referring to FIGS. 1 and 2, the upper body 21 defines a width equal to a width of the base member 20 when at a compressed position that is necessary such that the receptacle 10 can be readily stored, and further defines a spherical cavity 30 therein when adapted to the expanded position.

The device 10 provides an easy to use depository for empty food packets and other types of trash that accumulates on table in restaurants. Accordingly, such tables could be kept neat and tidy during a meal, and customers would not be embarrassed by clutter. Thus, the time to clean up would be greatly reduced, benefiting servers and busboys. Because the device 10 is disposable, it could simply be thrown away, saving time and space.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A collapsible and disposable trash receptacle sized and shaped to be seated on a dining table, said receptacle comprising:

a base member formed from flexible material comprising an inner layer and an outer layer abutted thereagainst; and an upper body monolithically formed with said base member and extending upwardly therefrom, said upper body having an open top end portion centrally aligned about a longitudinal axis of said receptacle, said upper body further having a deformably resilient outer surface comprising a plurality of pleats equidistantly spaced about a circumference of said upper body;

wherein said base member and said upper body are adaptable between compressed and expanded positions, said base member having a substantially cylindrical shape when adapted to an expanded position, said upper body having a spherical shape when adapted to an expanded position such that said upper body has a circumference greater than the circumference of said base member.

2. The receptacle of claim 1, wherein said pleats include a plurality of monolithically formed coextensive side portions radially extending away from the longitudinal axis and being adjustable between expanded and compressed positions such that a volume of the upper body can be selectively expanded when said side portions are adapted to a position tangential to the circumference of said upper body.

3. The receptacle of claim 1, wherein a bottom surface of said base member has a plurality of coextensive lines of weakness such that said base member can be compressed to a planar position.

4. The receptacle of claim 1, wherein said upper body defines a width equal to a width of said base member when at a compressed position such that said receptacle can be readily stored.

5. The receptacle of claim 1, wherein said upper body defines a spherical cavity therein when adapted to the expanded position.

6. A collapsible and disposable trash receptacle sized and shaped to be seated on a dining table, said receptacle comprising:

a base member formed from flexible material comprising an inner layer and an outer layer abutted thereagainst; and an upper body monolithically formed with said base member and extending upwardly therefrom, said upper body having an open top end portion centrally aligned about a longitudinal axis of said receptacle, said upper body further having a deformably resilient outer surface comprising a plurality of coextensive pleats equidistantly spaced about a circumference of said upper body;

wherein said base member and said upper body are adaptable between compressed and expanded positions, said base member having a substantially cylindrical shape when adapted to an expanded position, said upper body having a spherical shape when adapted to an expanded position such that said upper body has a circumference greater than the circumference of said base member.

7. The receptacle of claim 6, wherein said pleats include a plurality of monolithically formed coextensive side portions radially extending away from the longitudinal axis and being adjustable between expanded and compressed positions such that a volume of the upper body can be selectively expanded when said side portions are adapted to a position tangential to the circumference of said upper body.

8. The receptacle of claim 6, wherein a bottom surface of said base member has a plurality of coextensive lines of weakness such that said base member can be compressed to a planar position.

9. The receptacle of claim 6, wherein said upper body defines a width equal to a width of said base member when at a compressed position such that said receptacle can be readily stored.

10. The receptacle of claim 6, wherein said upper body defines a spherical cavity therein when adapted to the expanded position.

11. A collapsible and disposable trash receptacle sized and shaped to be seated on a dining table, said receptacle comprising:

a base member formed from flexible material comprising an inner layer and an outer layer abutted thereagainst; and an upper body monolithically formed with said base member and extending upwardly therefrom, said upper body having an open top end portion centrally aligned about a longitudinal axis of said receptacle, said upper body further having a deformably resilient outer surface comprising a plurality of coextensive pleats equidistantly spaced about a circumference of said upper body, wherein the longitudinal length of said pleats is greater than the width of said pleats, said pleats extending along a longitudinal length of said upper body and being simultaneously adaptable during operating conditions;

wherein said base member and said upper body are adaptable between compressed and expanded positions, said base member having a substantially cylindrical shape when adapted to an expanded position, said upper body having a spherical shape when adapted to an expanded position such that said upper body has a circumference greater than the circumference of said base member.

12. The receptacle of claim 11, wherein said pleats include a plurality of monolithically formed coextensive side portions radially extending away from the longitudinal axis and being adjustable between expanded and compressed positions such that a volume of the upper body can be selectively expanded when said side portions are adapted to a position tangential to the circumference of said upper body.

13. The receptacle of claim 11, wherein a bottom surface of said base member has a plurality of coextensive lines of weakness such that said base member can be compressed to a planar position.

14. The receptacle of claim 11, wherein said upper body defines a width equal to a width of said base member when at a compressed position such that said receptacle can be readily stored.

15. The receptacle of claim 11, wherein said upper body defines a spherical cavity therein when adapted to the expanded position.

* * * * *